United States Patent [19]

Stevenson

[11] 4,426,991

[45] Jan. 24, 1984

[54] STOVE CONSTRUCTION

[76] Inventor: Robert L. Stevenson, P.O. Box 370, Rogue River, Oreg. 97537

[21] Appl. No.: 321,095

[22] Filed: Nov. 13, 1981

[51] Int. Cl.[3] ..... F24C 1/14

[52] U.S. Cl. ..... 126/77; 126/160; 126/174; 126/60

[58] Field of Search ..... 126/152 R, 160, 174, 126/175, 176 R, 176 A, 77, 76, 69, 60, 61, 67

[56] References Cited

U.S. PATENT DOCUMENTS

| | | | |
|---|---|---|---|
| 245,578 | 8/1881 | Straszer | 126/174 |
| 384,177 | 6/1888 | Smith | 126/160 |
| 1,672,792 | 6/1928 | Thomas | 126/160 |
| 4,320,738 | 3/1982 | Johnson | 126/77 |

FOREIGN PATENT DOCUMENTS

| | | | |
|---|---|---|---|
| 529691 | 12/1921 | France | 126/174 |
| 180008 | 12/1935 | Switzerland | 126/175 |

*Primary Examiner*—James C. Yeung

*Attorney, Agent, or Firm*—Eugene M. Eckelman

[57] ABSTRACT

A stove firebox has a longitudinal opening in its bottom wall in which is supported upper and lower grates. The lower grate is slidable relative to the upper grate. Each grate has longitudinally spaced cross bars, and such cross bars and the openings therebetween have the same longitudinal dimension whereby upon offsetting the cross bars of the two grates longitudinally, an imperforate floor is provided and upon alignment of the cross bars, vertical passages are formed to sift ashes downward for cleaning the firebox. The slidable grate can be reciprocated to provide the sifting step. An interior draft inlet is provided at the bottom of the firebox adjacent the front.

1 Claim, 5 Drawing Figures

FIG. 1
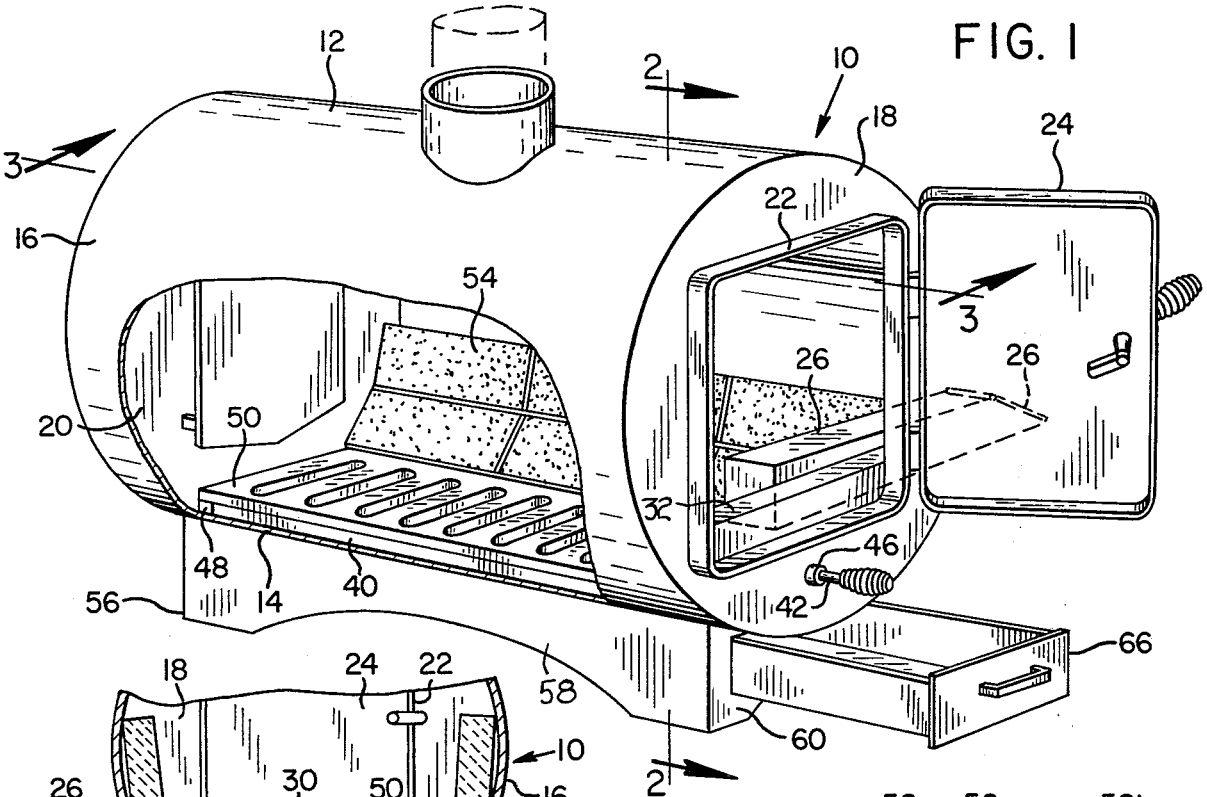
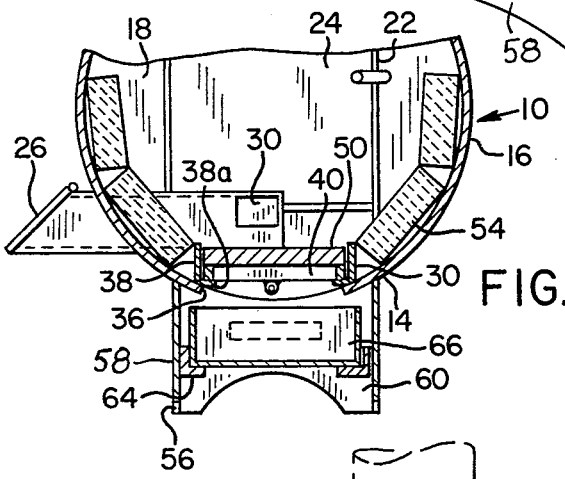
FIG. 2
FIG. 4
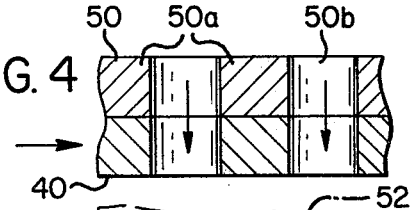
FIG. 5
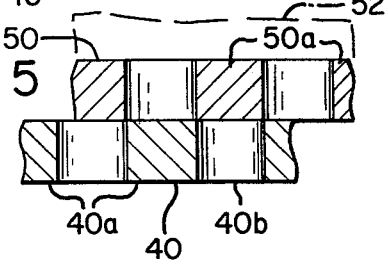
FIG. 3
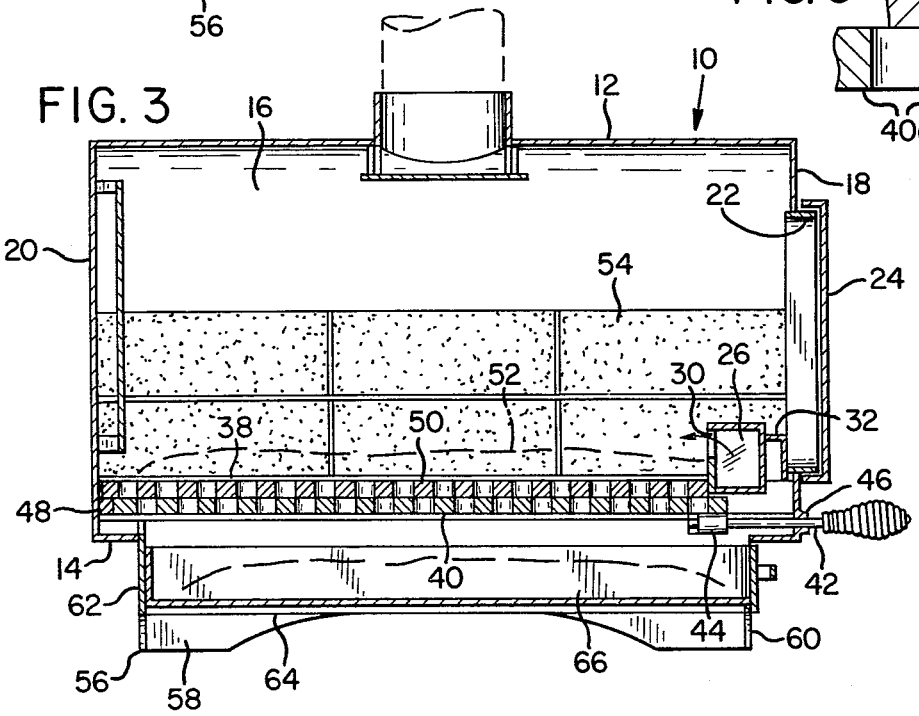

STOVE CONSTRUCTION

BACKGROUND OF THE INVENTION

This invention relates to new and useful improvements in stoves such as wood burning stoves and is particularly concerned with a grate construction.

Stoves have heretofore been provided with grates in the bottom wall for the purpose of allowing ashes to fall through for easy cleaning of the stove. These prior grates comprise interwoven fingers or the like which are spaced from each other so that ashes can fall through. Some of these prior structures have also had grates that can be manipulated for sifting ashes out of the firebox.

While such previous grate constructions are suitable for cleaning ashes from the firebox, they are not suitable for certain types of stoves, such as wood stoves, wherein it is desirable that a substantially solid bottom be maintained for the purpose of providing a floor for the fire as well as to provide a good controlled draft for the stove.

SUMMARY OF THE INVENTION

According to the present invention and forming a primary objective thereof, an improved grate arrangement is provided which functions to allow easy clean-out of ashes from the firebox and also to maintain a substantially solid bottom for the firebox for burning.

Structure for carrying out these main objectives comprises the combination of a pair of horizontal, longitudinally extending grates supported one on top of the other in an opening in the bottom wall of a firebox with each of the grates having a plurality of cross bars which are spaced to form openings therebetween. The cross bars and openings on both grates have the same longitudinal dimension so that upon offsetting the cross bars of the two grates longitudinally, an imperforate floor is provided. One of the grates is slidable longitudinally relative to the other grate so that upon reciprocation of the slidable grate, ashes can be sifted out of the firebox. In a preferred arrangement, the bottom grate has slidable support on longitudinal support means and the top grate is supported on top of the slidable grate and confined against longitudinal movement between the rear wall of the firebox and a front portion thereof. Projection means are provided at the rear wall of the firebox located for abutment by the slidable grate for positioning it in a rearward position in an offsetting relation of its cross bars with the cross bars of the top grate for forming the imperforate floor condition of the firebox.

The invention will be better understood and additional objects and advantages will become apparent from the following description taken in connection with the accompanying drawings.

BRIEF DESCRIPTION OF THE DRAWINGS

FIG. 1 is a perspective view of the present stove, a portion thereof being broken away to show internal construction;

FIG. 2 is a fragmentary cross sectional view taken on the line 2—2 of FIG. 1;

FIG. 3 is a longitudinal sectional view of the stove taken on the line 3—3 of FIG. 1; and FIGS. 4 and 5 are enlarged fragmentary sectional views showing relative positions of the top and bottom grates.

DETAILED DESCRIPTION OF A PREFERRED EMBODIMENT

With particular reference to the drawings, the numeral 10 designates a firebox of a stove such as a wood burning stove. Such a firebox has a top wall portion 12, a bottom wall portion 14, side wall portions 16, a front wall portion 18, and a rear wall portion 20. The shape of the firebox is illustrated as being cylindrical but it is to be understood that the invention can be used with any shape of firebox. The front wall 18 has a loading opening 22 associated with a hinged door 24. Draft means may be provided in the door or other forward portion of the wall 18, or as shown, such draft means can comprise a lateral tubular member 26 which leads inwardly from the exterior of the stove and terminates about halfway across the firebox. Such a draft arrangement is preferred in combination with the grate structure of the invention. The outer end of the draft tube 26 has suitable control dampers or the like, not shown. The inwardly extending portion of the tube 26 is closed except for an opening 30 facing the rear of the firebox. Draft tube 26 extends inwardly adjacent to the interior of the front wall 18. An ash guard 32 is disposed across the door opening between the wall 18 and the tube 26.

The bottom wall 14 of the stove has a longitudinal opening 36 which terminates short of the front and rear of the firebox. Angle iron guides 38 are welded or otherwise integrated with the bottom wall 14 longitudinally along each side of the opening 36 and have inturned portions **38*a* arranged to freely support a bottom grate 40 in a plane just below the bottom wall of draft tube 26. Bottom grate 40 is of less length than the firebox and has a handle 42 secured to the bottom portion thereof at the front. This handle has threaded engagement in a depending tapped extension 44 on the grate 40 and passes through a guide opening 46 in the front wall 18 of the firebox. Grate 40 abuts at its rearward end against a forward projection 48** in the firebox.

A top grate 50 seats freely on top of the grate 40 and is confined against longitudinal movement between the rear wall 20 of the firebox and the draft tube 26.

Grate 40 comprises a plurality of spaced cross bars **40*a* with openings 40*b* therebetween. Top grate 50 is similarly constructed of cross bars 50*a* with openings 50*b* therebetween. The cross bars 40*a* and 50*a* as well as the openings 50*a* and 50*b* all have the same longitudinal dimension so that when the bars 40 and 50 are offset longitudinally, namely, when bars 50*a* are over the openings 40*b*, as seen in FIGS. 3 and 5, an imperforate floor is provided in the firebox and ashes 52 can collect. The projection 48 has the same longitudinal dimension as the bars 40 or 50 so that when the bottom grate is in a rearwardmost position against such projection and the top grate is supported thereon and confined between the rear wall 20 of the firebox and the draft tube 26**, the grate assembly will be closed to form the imperforate floor structure.

When desired, ashes can be cleared from the firebox by reciprocating the lower grate by means of handle 42. Otherwise, it is desired that the bottom grate be positioned rearwardly against the projection 48 so that the two grates form an imperforate floor. By the formation of such an imperforate floor by the grates, there can be a desired support of the combustible material. This also allows a build-up of ashes 52 for the protection of the grates as well as for keeping out draft into the firebox from the bottom, whereby precise drafting conditions can be controlled through the draft tube 26.

If it is desired to remove the grates, the top grate is first lifted up and removed through the door opening. The bottom grate likewise can then be lifted up after unthreading the handle 42.

Suitable fire bricks 54 are provided in the firebox, the guides 38 forming supports for such bricks.

The base 56 for the firebox comprises a hollow, box-like structure open at the top and bottom and integral with the bottom wall of the firebox. It has side walls 58, a front wall 60 and a rear wall 62. Side walls 58 have longitudinal guides 64 for supporting a drawer 66 adapted to catch ashes from the firebox. Drawer 66 is aligned with a front opening 68 in the front wall 60 for removal.

It is to be understood that the form of my invention herein shown and described is to be taken as a preferred example of the same and that various changes in the shape size and arrangement of parts may be resorted to without departing from the spirit of my invention, or the scope of the subjoined claims.

Having thus described my invention, I claim:

1. A stove construction comprising a firebox having top, bottom, side, front and rear wall portions, an opening in said bottom wall extending longitudinally in the direction of front to rear, longitudinal support means extending along opposite sides of said opening, a first grate supported on said longitudinal support means for slidable movement, a second grate supported on said first grate, a tubular housing leading inwardly into said firebox from one side and at the front, said housing having an outer draft inlet end and an inner draft opening facing rearwardly in a plane immediately above the said second grate, said second grate being confined against longitudinal movement between said tubular housing and the rear wall of the firebox, each of said grates having a plurality of spaced cross bars forming openings between said bars, said cross bars and openings on both grates having the same longitudinal dimension whereby upon offsetting the cross bars of the two grates longitudinally, an imperforate floor is provided and upon aligning the cross bars longitudinally, holes are provided in the floor, projection means on the rear wall of said firebox located for rear abutment by said first grate for positioning the latter in its rearward position in said offsetting relation of its cross bars with the cross bars of said second grate, said first grate being slidable longitudinally relative to said second grate whereby upon reciprocation of said first grate, ashes are caused to be sifted through said grates, said slidable grate terminating short of said front wall to allow reciprocation of said slidable grate for shaking ashes down through said opening.

* * * * *